United States Patent [19]

Ishida et al.

[11] Patent Number: 4,473,056

[45] Date of Patent: Sep. 25, 1984

[54] EXHAUST GAS RECIRCULATION VALVE AND METHOD OF CONTROLLING THE VALVE

[75] Inventors: Takashi Ishida, Ohi; Noboru Tominari, Tokyo, both of Japan

[73] Assignee: Mikuni Kogyo Kabushiki Kaisha, Tokyo, Japan

[21] Appl. No.: 378,083

[22] Filed: May 14, 1982

[30] Foreign Application Priority Data

May 25, 1981 [JP] Japan ..... 56-78050

[51] Int. Cl.[3] ..... F02M 25/06

[52] U.S. Cl. ..... 123/571; 364/431.06

[58] Field of Search ..... 123/571

[56] References Cited

U.S. PATENT DOCUMENTS 4,064,851 12/1977 Wessel ..... 123/571

FOREIGN PATENT DOCUMENTS 57-193751 11/1982 Japan ..... 123/571

2042770 9/1980 United Kingdom ..... 123/571

*Primary Examiner*—Wendell E. Burns

*Attorney, Agent, or Firm*—Owen, Wickersham & Erickson

[57] ABSTRACT

An exhaust gas recirculation valve driven by an electric motor. The valve comprises a housing having an inlet port and an outlet port, a valve member disposed within said housing, an electric motor attached to the upper portion of said housing, a changing means for changing the rotation of said electric motor into the vertical movement of said valve member, said changing means being disposed between the shaft of said electric motor and a valve rod. The valve member is operated by said electric motor through the intermediary of said changing means. Therefore, the valve can be controlled delicately independent of the engine manifold vacuum. The valve may be incorporated into an electronic fuel injection system adapted to calculate the amount of fuel supply to an internal combustion engine by means of a control unit so as to obtain an optimum air-fuel mixture or air-fuel ratio. In this case, an actuating signal calculated on the basis of said amount of fuel supply and the information of sensors is given to said electric motor so as to obtain an optimum opening of the valve. Therefore, the valve can be controlled very accurately.

4 Claims, 4 Drawing Figures

EXHAUST GAS RECIRCULATION VALVE AND METHOD OF CONTROLLING THE VALVE

BACKGROUND OF THE INVENTION

1. Field of the Invention

The present invention relates to an exhaust gas recirculation valve (hereinafter referred to as "EGR valve") driven by an electric motor. More particularly, it relates to an EGR valve adapted to operate so as to give a determined optimum amount of exhaust gas recirculation (hereinafter referred to as "EGR") necessary for emission control, the operation thereof being independent of the influence of mainfold vacuum.

2. Description of the Prior Art

Most of conventional EGR valves, as found for instance in U.S. Pat. Nos. 4,066,056 and 4,090,482, are provided in the upper portion of their valve housing with a diaphragm chamber connected to an engine manifold, and are adapted to be opened and closed by manifold vacuum introduced into said diaphragm chamber by some means or other. In these EGR valves, an opening thereof suitable for an engine load is obtained by elaborated means of introducing manifold vacuum into said diaphragm chamber. However, when a larger opening of the valve is necessary, the vacuum itself is reduced. On the other hand, when a very small opening thereof is necessary, the vacuum becomes too high. Thus, the conventional EGR valves have the disadvantage that the opening thereof has to be controlled under such incompatible conditions.

BRIEF SUMMARY OF THE INVENTION

It is an object of the present invention to provide an EGR valve, the opening of which can be controlled independent of the above-mentioned critical restrictive conditions. This object has been attained by an EGR valve which is driven by an electric motor.

It is another object of the present invention to provide a method of controlling an EGR valve so as to ensure an optimum amount of EGR. This object has been attained by a method in which the EGR valve is incorporated into an electronic fuel injection system and an optimum opening of the valve is obtained by driving a valve operation motor on the basis of the amount of fuel supply or air supply to the engine calculated by a control unit.

DETAILED DESCRIPTION

The present invention will now be described in detail with reference to the attached drawings.

Figure 1:
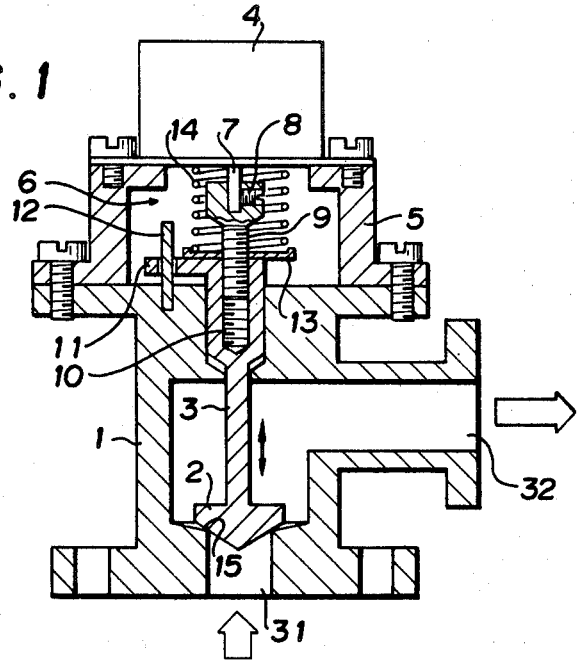
FIG. 1 is a vertical sectional view of an EGR valve according to an embodiment of the present invention.

Referring to FIG. 1 which is a vertical sectional view of an EGR valve according to an embodiment of the present invention, numeral 1 represents a valve housing, numeral 2 is a valve member, numeral 3 a valve rod, numeral 4 an electric motor, numeral 5 a motor supporting member, and numeral 6 a changing means for changing the rotation of the electric motor 4 into the vertical movement of the valve rod 3. Said changing means 6 comprises an externally threaded member 9 fastened to the end of the output shaft 7 of the electric motor 4 by means of a setscrew 8, an internally threaded portion 10 formed in the upper portion of the valve rod 3, said internally threaded portion 10 being in engagement with the externally threaded member 9, a lever 11 extending from the top of the valve rod 3, and a pin 12 inserted into the lever 11 so as to prevent the rotation of the valve rod 3 and to guide the vertical movement thereof. A washer 13 and a spring 14 are disposed between the bottom of the electric motor 4 and the top of the valve rod 3 so as to push the valve member 2 toward its valve seat 15.

In FIG. 1, the valve member 2 is in close contact with the valve seat 15 and EGR is stopped. When the electric motor 4 is rotated in the normal direction in this state, the externally threaded member 9 is rotated thereby, and the valve rod 3 is moved up, the rotation of the valve rod 3 being prevented by the lever 11 and the pin 12. Therefore, the valve is opened, and part of engine exhaust gas is introduced through an inlet port 31 into a valve chest and delivered through an outlet port 32. When the electric motor 4 is rotated in the reversed direction after the valve has been opened, the valve rod 3 is moved down and the opening of the valve is reduced so as to decrease the amount of exhaust gas introduced. When the electric motor 4 is further rotated in said reversed direction, the valve member 2 is brought into contact with the valve seat 15 and the valve is closed as shown in FIG. 1.

In the aforesaid conventional EGR values connected to the engine manifold, it is very difficult to obtain a desired valve opening at a partial load at which the delicate control of the valve opening is required, because the valve opening is directly influenced by manifold vacuum. However, in the EGR valve of the present invention, even if the manifold pressure difference between portions before and after the valve is sharply change, the opening of the valve is not at all influenced thereby. Therefore, it is possible to obtain a desired valve opening, irrespective of the engine load, by giving instructions to the electric motor. It is apparent that the EGR valve of the present invention can be easily controlled when it is incorporated into an electronic fuel injection system having a control computer.

Figure 2:
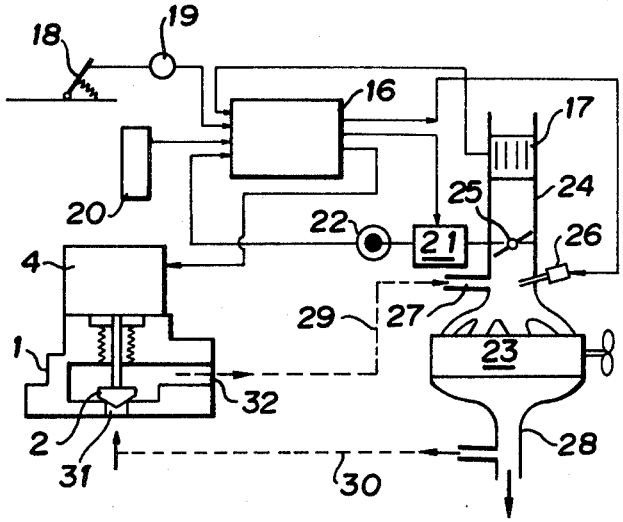
FIG. 2 is a block diagram showing a system in which a method of controlling an EGR valve is used.

FIG. 2 shows a system embodying a method of controlling said EGR valve incorporated into the electronic fuel injection system. A control unit 16 drives an injector 26 according to the output of a fuel flow command potentiometer 19 which is actuated by the operation of an accelerator 18. At this time, the control unit 16 receives, according to the operational condition of the engine, the output of an air flow sensor 17 and the output of a throttle actuator 21 through the intermediary of a potentiometer or encoder 22, as well as it receives, in the forms of electric signals, various information such as the temperature of cooling water, the temperature of the engine cylinder head, the number of revolution of the engine, atmospheric temperature, atmospheric pressure, fuel supply line pressure, etc. which are detected by sensors 20. The optimum amount of air is calculated on the basis of these inputs. Signals of the control unit 16 are delivered to the throttle actuator 21 and the electric motor 4 of the EGR valve. Said air flow sensor 17, a throttle valve 25, said injector 26 and an EGR inlet 27 are disposed within the intake bore 24 of the engine 23. Said EGR inlet 27 is connected to the outlet port 32 of the EGR valve by means of a passage 29. A bypass 30 is provided between the exhaust bore 28 of the engine 23 and the inlet port 31 of the EGR valve.

Said control unit 16, which is the same as disclosed by U.S. patent application Ser. No. 228,973, compares the above-mentioned inputs and signals with memories programmed in advance on the basis of the aforesaid various factors and the functional relationships between the parameters of the sensors, and determines an optimum amount of air supply by correcting a necessary amount of air supply calculated from fuel flow input. As a result, the control unit 16 delivers an electric signal for determining the opening angle of the throttle valve 25, and actuates the throttle valve 25 thereby so as to ensure the optimum amount of air supply. On the basis of the amount of fuel supply or air supply to the engine calculated by the control unit 16, the control unit 16 delivers an electric signal for controlling EGR, that is, for controlling the opening of the EGR valve in order to ensure an optimum amount of EGR. As the optimum amount of EGR necessary for emission control depends upon the sensors and the load of the engine, the opening and performance characteristics of the EGR valve are memorized in advance by the control unit 16.

Figure 3:
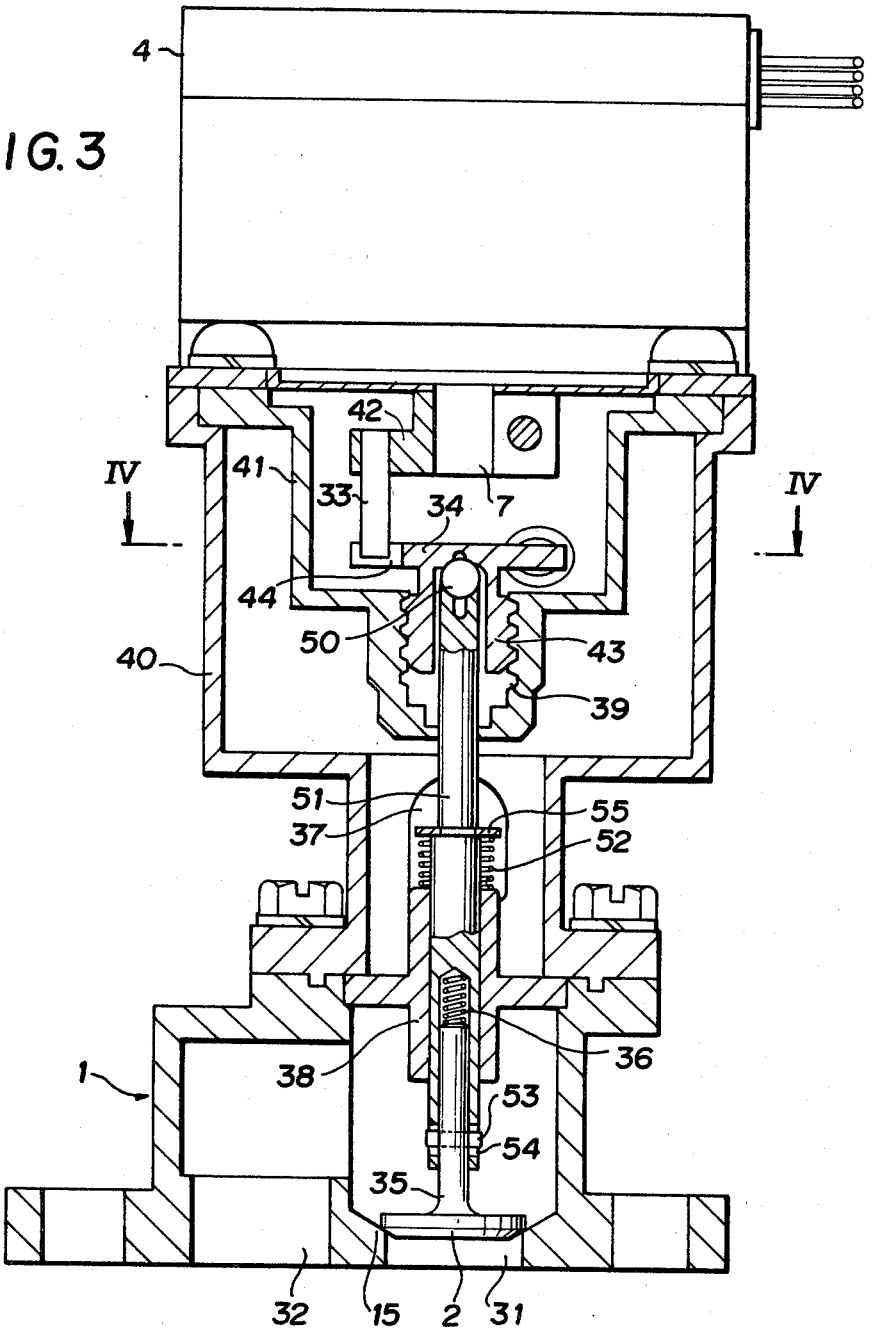
FIG. 3 is a vertical sectional view of an EGR valve according to another embodiment of the present invention.
Figure 4:
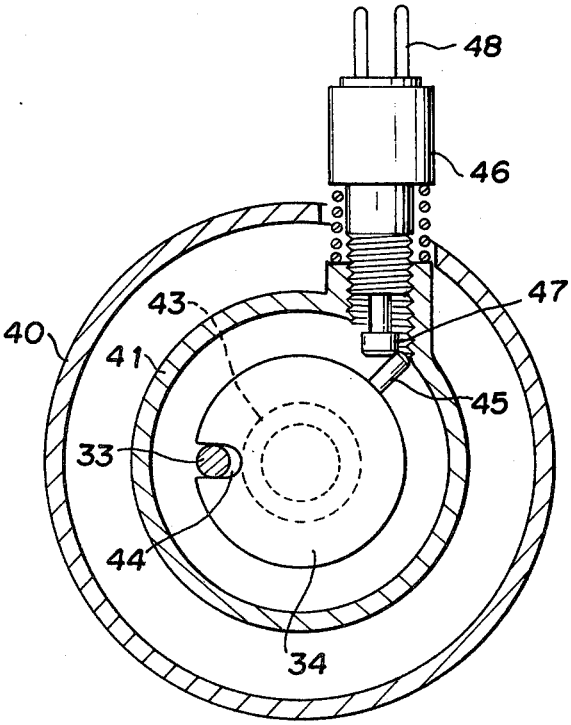
FIG. 4 is a sectional view taken on line IV—IV of FIG. 3.

FIGS. 3 and 4 show an EGR valve according to another embodiment of the present invention. In this embodiment, a pin 33 and a disc-shaped holder 34 are disposed between the output shaft 7 of a stepping motor 4 and an externally threaded hollow cylinder 43 so that the output shaft 7 does not receive thrust. A valve rod 35 is provided with a spring 36 for absorbing overstrokes so as to prevent the sticking of the valve member 2.

As shown in FIG. 3, a valve guide 38 is provided in the upper portion of a valve housing 1, and a motor housing 40 is disposed on top of the valve housing 1, said stepping motor 4 being supported on the motor housing 40. The lower portion of the motor housing 40 has a small diameter and is provided with an opening 37 for cooling a valve shaft 51. A screw housing 41 provided in its center with an internally threaded portion 39 is secured within the motor housing 40. An arm 42 is secured to the output shaft 7 of the stepping motor 4 by means of a screw. The arm 42 is provided at its end with an opening into which said pin 33 is fitted downwardly. The top of said externally threaded hollow cylinder 43, engaged with the internally threaded portion 39 of the screw housing 41, forms said disc-shaped holder 34. The disc-shaped holder 34 has a notch 44 into which said pin 33 is inserted, and is provided at its edge with a projecting dog 45 which, when the valve is fully closed, comes into contact with a sensor 46 for detecting the full closed position of the valve. See FIG. 4.

A steel ball 50 is disposed within said externally threaded hollow cylinder 43 so that the disc-shaped holder 34 of the externally threaded hollow cylinder 43 is associated with the top of the valve shaft 51 through the intermediary of the steel ball 50 and the valve shaft 51 is moved vertically without being rotated. The valve shaft 51 is provided halfway with a return spring 52 and a spring holder 55. The central portion of the valve shaft 51 is guided by said valve guide 38. The lower portion of the valve shaft 51 is a hollow cylindrical portion into which the valve rod 35 is inserted. The valve rod 35 is provided in its approximately central portion with a pin 53 having a small diameter, the projecting ends of said pin 53 being respectively inserted into loose holes 54 provided in the hollow cylindrical portion of the valve shaft 51, each of eaid loose holes 54 being larger than the diameter of the pin 53. The valve rod 35 is further provided at its top with said spring 36 for absorbing overstrokes.

When the valve is fully closed, the valve member 2 is lightly pressed against the valve seat 15 by the force of said spring 36, and the pin 53 is either in contact with the upper limit of the loose holes 54 or in a position near it. Even when the externally threaded hollow cylinder 43 has started to rotate, the valve rod 35 does not immediately start to move up. It is not until the valve shaft 51 starts to move up and the pin 53 comes into contact with the lower limit of the loose holes 54 that the valve rod 35 starts to move up with the valve shaft 51 and lift the valve member 2 from the valve seat 15.

When the valve is fully closed, the dog 45 of the disc-shaped holder 34 contacts and pushes a contact piece 47 provided at the end of said sensor 46. Thereby the sensor 46 is actuated and sends a signal to said control unit 16. When the valve is not in the fully closed position, the dog 45 does not contact the contact piece 47 of the sensor 46 and therefore the sensor 46 does not send any signal to the control unit 16, because the disc-shaped holder 34 of the externally threaded hollow cylinder 43 moves up at a rate of one pitch (for instance 2.5 mm) per rotation while rotating. Numeral 48 in FIG. 4. represents a terminal through which the above-mentioned signal is transmitted.

When the stepping motor 4 rotates, the disc-shaped holder 34 and the externally threaded hollow cylinder 43 are rotated thereby through the pin 33 provided at the end of the arm 42. The thrust of the externally threaded hollow cylinder 43 is not transmitted to the output shaft 7 of the stepping motor 4 because the thrust is absorbed by the sliding between the pin 33 and the notch 44 of the disc-shaped holder 34.

If the externally threaded hollow cylinder 43 is rotated and moved up when the valve is fully closed as shown in FIG. 3, the valve shaft 51 moves up and the pin 53 comes into contact with the lower limit of the loose holes 54. Then, the valve rod 35 moves up and the valve member 2 separates from the valve seat 15. Now the valve is open and allows exhaust gas to flow through it. The degree of the valve opening is determined by the instructions from the control unit 16 as mentioned above with reference to FIG. 2.

When the amount of EGR is to be decreased according to the operational condition of the engine, the valve rod 35 is moved down by rotating the stepping motor 4 in the reversed direction. When the valve rod 35 reaches the lowest limit, the dog 45 of the disc-shaped holder 34 contacts the contact piece 47 of the sensor 46, and the sensor 46 emits a signal to stop the stepping motor 4. At this time, even if the stepping motor 4 makes an error in the angle of rotation or rotates too much by inertia, the spring 36 absorbs the overstroke to prevent the sticking of the valve member 2.

The present invention has the following advantages: The opening of the EGR valve can be controlled delicately independent of the engine manifold vacuum because the valve member is driven by the electric motor through the intermediary of the changing means which changes the rotation of the electric motor into the vertical movement of the valve rod. Furthermore, when the EGR valve driven by the electric motor is associated with the control unit of the electronic fuel injection system, the EGR valve can be controlled very accurately because control signals calculated on the basis of the amount of fuel supply or air supply and the information of the sensors can be used as valve actuating signals.

As many apparently widely different embodiments of the present invention may be made without departing from the spirit and scope thereof, it is to be understood that the invention is not limited to the specific embodiments thereof except as defined in the appended claims.

What is claimed is:

1. An exhaust gas recirculation valve comprising a valve housing having an inlet port and an outlet port, a valve member vertically movably disposed within said valve housing, an electric motor supported on a motor housing on top of said valve housing, an internally threaded member secured in the center of said motor housing, a pin provided at the end of an arm secured to the shaft of said electric motor, an externally threaded member engaged with said internally threaded member, said externally threaded member being provided at its top with a disc-shaped holder having a notch into which said pin is inserted, said externally threaded member further having a hollow cylindrical portion into which the upper end of a valve shaft is inserted, a steel ball disposed between the upper inner surface of said hollow cylindrical portion of said externally threaded member and the upper end of said valve shaft, and a return spring disposed around said valve shaft so as to give said valve shaft a tendency to move up.

2. An exhaust gas recirculation valve as claimed in claim 1, wherein the lower portion of said valve shaft is a hollow cylindrical portion containing a spring for absorbing the overstrokes of said valve member, and a valve rod is vertically movably supported in said hollow cylindrical portion.

3. An exhaust gas recirculation valve as claimed in claim 2, wherein said valve rod is provided in its approximately central portion with a small pin, the projecting ends of said pin being respectively inserted into loose holes provided in the lower portion of said valve shaft.

4. An exhaust gas recirculation valve as claimed in claim 1, wherein said disc-shaped holder is provided at its edge with a projecting dog, and said motor housing has a sensor for detecting the full closed position of the valve, said dog being adapted to contact and actuate said sensor when the valve is fully closed.

* * * * *